US010081206B1

(12) United States Patent
Meuleman

(10) Patent No.: US 10,081,206 B1
(45) Date of Patent: Sep. 25, 2018

(54) PRINTING SYSTEM HAVING FOUR-BAR LINKAGE MECHANISMS FOR POSITIONING ITS PRINT MODULES

(71) Applicant: SPGPrints B.V., Boxmeer (NL)

(72) Inventor: Peter Klein Meuleman, Venlo (NL)

(73) Assignee: SPGPrints B.V., Boxmeer (NL)

( * ) Notice: Subject to any disclaimer, the term of this patent is extended or adjusted under 35 U.S.C. 154(b) by 0 days.

(21) Appl. No.: 15/456,787

(22) Filed: Mar. 13, 2017

(51) Int. Cl.

| | |
|---|---|
| ***B41J 25/308*** | (2006.01) |
| ***B41J 2/165*** | (2006.01) |
| ***B41J 25/00*** | (2006.01) |
| ***B41J 25/34*** | (2006.01) |

(52) U.S. Cl.
CPC ..... *B41J 25/3086* (2013.01); *B41J 2/165* (2013.01); *B41J 2/16585* (2013.01); *B41J 25/001* (2013.01); *B41J 25/006* (2013.01); *B41J 25/308* (2013.01); *B41J 25/34* (2013.01); *B41J 2002/16502* (2013.01); *B41J 2202/14* (2013.01); *B41J 2202/20* (2013.01)

(58) Field of Classification Search
CPC ..... B41J 2/3088; B41J 2/3086
See application file for complete search history.

(56) References Cited

U.S. PATENT DOCUMENTS

| | | | | |
|---|---|---|---|---|
| 6,012,810 | A * | 1/2000 | Ohashi | B41J 11/20 271/145 |
| 7,008,482 | B2 * | 3/2006 | Goto | B41J 2/145 118/305 |
| 2006/0139400 | A1 * | 6/2006 | Nellen | B41J 2/17593 347/37 |
| 2013/0100207 | A1 * | 4/2013 | Van Der Zwan | B41J 25/308 347/37 |
| 2017/0072722 | A1 * | 3/2017 | Mueller | B41J 11/0095 |
| 2017/0259596 | A1 * | 9/2017 | Elferink | B41J 19/00 |

FOREIGN PATENT DOCUMENTS

WO 2011/157282 A1 12/2011

* cited by examiner

*Primary Examiner* — Shelby Fidler
(74) *Attorney, Agent, or Firm* — Hoffmann & Baron, LLP

(57) ABSTRACT

A printing system comprises a sub-frame (5), a print module (8) with printheads (27), a first support unit (30) that is connected to the sub-frame (5), in particular movable in a displacement direction (z) relative to the sub-frame, a substrate holder (2) for supporting a substrate (3), and a positioning mechanism for moving the print module relative to the first support unit to and from a print position. A set of positioning parts (34-36) and positioning references (14-16) is provided that form part of or are connected to the print module (8) respectively the sub-frame (5). The positioning parts (34-36) are engageable with corresponding ones of the positioning references (14-16) for aligning the print module (8) relative to the sub-frame (5) when moved into its print position. The positioning mechanism comprises one or more four-bar linkage mechanisms (32) acting between the print module (8) and the first support unit (30).

16 Claims, 12 Drawing Sheets

PRINTING SYSTEM HAVING FOUR-BAR LINKAGE MECHANISMS FOR POSITIONING ITS PRINT MODULES

The invention relates to a printing system with one or more print modules that are positionable in a print position above a substrate to be printed, and that each have a carrier with one or more printheads connected thereto.

Issues when designing and using such a printing system, especially in industrial environments, include accurately aligning the printheads for operation purposes, and allowing easy maintenance of the printheads, including easy replacement of printheads.

Prior art printing systems usually lack easy access to printheads for maintenance purposes, or in case easy access is provided, a complex and lengthy alignment process is required following the maintenance resulting in relatively long downtime of the printing system.

Known scanning printing systems for example comprise a plurality of print modules and for each of them a set of positioning units that is connected to a frame. Each positioning unit is configured to receive a respective support end of a carrier of a print module for positioning that print module in an accurately aligned print position. Positioning/displacement mechanisms are provided for moving individual ones of the print modules to and from the positioning units between a maintenance position and the print position. These positioning/displacement mechanisms each include their own certain amount of play. Each set of positioning units for example comprises fixedly mounted reference side stops, reference bottom stops and a reference side stop against which corresponding reference side surfaces, reference bottom surfaces and a head end surface of the respective support ends of the carrier can be pushed by means of resilient elements in order to thus obtain its accurately aligned print position.

A disadvantage with this is that during movements of the print modules from their maintenance positions towards their print positions, the support ends of the carriers may accidentally bump against one or more of the reference stops of the positioning units. Also it may occur that during movements of the print modules between their maintenance and print positions, the reference head end surface and/or the reference side surfaces of the support ends of the carrier get rubbed along the reference head stop and/or the reference side stops of the positioning units. Both the bumping and rubbing may lead to a damaging and/or wearing of the reference surfaces of the support ends and/or the reference stops of the positioning units, because of which an accurate positioning may no longer be possible.

WO 2011/157282 discloses a single-pass printing system in which an assembly of print modules all together can be moved up and down by means of a lifting mechanism. Each print module hangs freely swingable underneath a telescopic rail. In a lifted position each individual print module can be pulled forward after which it can be taken off for maintenance purposes. In a pushed inward position, the assembly of print modules can all together as an assembly be lowered by means of one common positioning/displacement mechanism. Each print module then first gets coarsely positioned by means of cooperating catching mechanisms. Subsequently a fine alignment takes place in which the print modules are automatically led with downwardly projecting ball pivots towards upwardly opening ball pivot guidances. At an upper end of the print module a side stop is provided for further delimiting and aligning the print module in the print position.

A disadvantage with this system is that the functioning of the positioning/displacement mechanism leaves to be improved. For example it is unable to stably hold and guide the print modules during movements from their maintenance positions towards their print positions and vice versa. Another disadvantage is that the positioning/displacement mechanism is relative complex and expensive to manufacture. Furthermore it is disadvantageous that its positioning/displacement mechanism needs to make use of gravity forces during not only its coarse positioning but also during its fine alignment movements as well as for keeping the modules aligned in their print positions. This makes the system only suitable for substantially vertically orientated lifting and lowering directions, and unsuitable for types of printing systems in which the print modules may get moved at high speeds during printing, for example scanning printing systems. Another disadvantage is that the swinging connection between the print modules and their telescopic rails makes the print modules somewhat instable when pulled outwards to their maintenance positions. They may even bump against each other or against other objects in their neighbourhood, leading to possible damaging of the vulnerable print modules themselves or to the objects in their neighbourhood. Yet another disadvantage is that the ball pivot guidances and side stop lie at relative large distances of the substrate to be printed. This makes the alignment vulnerable for building up of tolerance, temperature expansion, etcetera.

The present invention aims to overcome those disadvantages at least partly or to provide a usable alternative. In particular the present invention aims to provide a user-friendly and improved printing system that allows easy access to the printheads for maintenance and that is well able to guarantee a simple and efficient accurate alignment process after such maintenance for many times.

This object is achieved by a printing system according to claim 1. The printing system comprises a sub-frame, a print module having a carrier with one or more printheads connected thereto, a first support unit that is connected to the sub-frame, in particular movable in a displacement direction relative to the sub-frame, a substrate holder for supporting a substrate to be printed on by the print module, and a positioning mechanism for moving the print module relative to the first support unit to and from a print position. A set of positioning parts is provided that form part of or are connected to the print module, and a set of positioning references is provided that form part of or are connected to the sub-frame. The positioning parts are engageable with corresponding ones of the positioning references for aligning the print module relative to the sub-frame when moved into its print position. According to the inventive thought the positioning mechanism comprises one or more four-bar linkage mechanisms acting between the print module and the first support unit.

The four-bar linkage mechanism forms a stable and reliable connection between the first support unit and the print module. It is able to quickly guide the print module during movements to and from its print position. With this the four-bar linkage mechanism advantageously can be designed to let the print module perform a combined translation-rotation movement along a specifically desired imaginary path. This makes it possible for each of the positioning units to substantially at a same time come into full engagement with its corresponding positioning reference, without anyone of the positioning units being able to prematurely come into contact with its positioning reference, which could otherwise lead to wear or damaging and thus to a deterioration of the positioning accuracy. Thus an accurate positioning of the print module remains possible over and over again.

The four-bar linkage mechanism has appeared to be able to provide for a very quick positioning movement including a very accurate fine self-alignment movement of the print module with its positioning units into full engagement with their corresponding positioning references. Another important advantage of the four-bar linkage mechanism according to the invention is that it no longer needs to make use of gravity. This makes the system suitable for any orientation of displacement directions of its print modules, and also suitable for printing systems in which one or more print modules are placed in a carriage that gets moved back and forth at high speeds during printing, for example in scanning printing systems, causing the carriage and the print modules to be exposed to high acceleration and deceleration forces.

In a preferred embodiment the four-bar linkage mechanism can be designed to move the print module to and from the positioning references while allowing the print module to move relative to the first support unit in six degrees of freedom when the positioning parts of the print module start engaging with the positioning references. This compliance of the four-bar linkage mechanism gives the print module some play when having its positioning units trying to find their accurately aligned full engagement with their positioning references. For obtaining this compliance, arms of the four-bar linkage mechanism that extend between and are connected to the print module and first position unit can be constructed somewhat flexible, for example as leaf springs, or can be constructed with a part that is resiliently compressible or stretchable during positioning. In addition thereto or in the alternative it is also possible to have the arms connect to the print module and first position unit via hinge joints that can be constructed somewhat flexible, or can be constructed with a part that is resiliently compressible or stretchable during positioning.

In a preferred embodiment at least one of the hinge joints of each arm of the four-bar linkage mechanism may comprise a slidable pen-slit connection. This slidable pen-slit connection is able to provide the mechanism with a desired main compliance/flexibility in a specifically aimed direction, and has the advantage that the direction of this main compliance/flexibility can easily be selected by choosing a suitable orientation for the slit to extend in.

In a further preferred embodiment the pen then can be biased towards an intermediate position inside the slit by means of one or more springs. The spring(s) then advantageously may help in biasing the positioning units of the print module to be forced with a specific biasing force against their positioning references in the print position. The springs also help to prevent one of the outer head ends of the slit to bump against the pen of the hinge joint during operation, where it may otherwise start to exert too high forces via the print module onto the positioning references leading to a damaging of those positioning references.

In an embodiment a second support unit can be provided that is movable in the displacement direction relative to the sub-frame and to which the first support unit is mounted via a first guiding mechanism, preferably a linear guide, that allows the first support unit to be moved together with as well as relative to the second support unit in the displacement direction. Advantageously a force actuator can then be provided between the second support unit and the print module such that a relative moving of the first and second support units towards and away from each other in the displacement direction causes the four-bar linkage mechanism to be operated by means of the force actuator. Thus a fully automatic actuation of the four-bar linkage mechanism is provided.

The second support unit is operable to move in the displacement direction relative to the sub-frame, for example by means of a pion-rack or a screw spindle along which it can be displaced manually or automated. With this the second support unit is able to take along the first support unit with it that is connected thereto via the first guiding mechanism, as well as taking along the print module that is connected to the first support unit via the four-bar linkage mechanism. Starting from for example a maintenance or a position that lies intermediate such a maintenance position and the print position, the second support unit can be operated to move in the displacement direction while taking the first support unit and print module along with it, until the first support unit gets blocked in this displacement direction, for example by running against a stop organ like a part of the sub-frame. A continuation of the operation to move the second support unit in the displacement direction then shall cause the force actuator to start exerting a pushing force onto the print module and thus start to operate the four-bar linkage mechanism and have the print module move relative to the blocked first support unit towards its print position. Starting from the print position, the second support unit can be operated to move in the opposite direction. As long as the first support unit is kept blocked, the second support unit shall move away from the first support unit. The force actuator then can start exerting a pulling force onto the print module and thus start to operate the four-bar linkage mechanism and have the print module move relative to the blocked first support unit away from its print position. As soon as the first support unit gets unblocked, for example by getting lifted from the stop organ like the part of the sub-frame, then a continuation of the operation to move the second support unit in the opposite displacement direction shall cause the first support unit and print module to be taken along with it.

The first guiding mechanism between the first and second support unit preferably comprises a spring for biasing the first and second support unit away from each other. Thus the first and second support in each orientation can automatically be pushed away from each other towards a starting position in which the force actuator is not operated.

In an advantageous embodiment the force actuator may comprise an arm that extends between the print module and the second support unit, wherein the arm is connected to the print module and the second support unit by means of hinge joints, and wherein one of those hinge joints comprises a slidable pen-slit connection. This slidable pen-slit connection is able to provide the mechanism with a desired main compliance/flexibility in a specifically aimed direction, and has the advantage that the direction of this main compliance/flexibility can easily be selected by choosing a suitable orientation for the slit to extend in.

In a further embodiment the force actuator operates a spring that is placed between the force actuator and the print module. This spring then advantageously may help in biasing the positioning units of the print module to be forced with a specific biasing force against the positioning references in the print position. The spring also helps to prevent the force actuator to bump rigidly against the print module during operation, where it may otherwise start to exert too high forces via the print module onto the positioning references.

In a variant the second support unit can be mounted to the sub-frame via a second guiding mechanism, preferably a linear guide, more preferably a telescopically extendable rail, allowing the second support unit to be moved in a direction other than the displacement direction, in particular perpendicular thereto, towards a maintenance position. Thus a truly accessible maintenance position can be obtained for the print module that may even lie outside boundary walls of the sub-frame.

The four-bar linkage mechanism can have all kinds of dimensioned and orientated arms in order to obtain its desired movement path when operated. Preferably it however is a parallelogram four-bar linkage mechanism. The advantage hereof is that a symmetric load distribution gets transferred to the print module and that it may help to keep the system compact.

In a preferred embodiment the sub-frame may comprise a base plate with one or more openings for giving the one or more print heads of the print module access to the substrate in the print position, which base plate extends in a first and second direction that are perpendicular to each other and to the displacement direction. The set of positioning references then may comprise three positioning references, a first and second one of which are provided spaced from each other in the first direction at a same position in the second and displacement direction, and a third one of which is provided spaced from the first and second ones in the second and displacement direction. Thus with merely three positioning references an accurate alignment can be achieved in six degrees of freedom.

The third one of the positioning references preferably may get provided at a center position in the first direction in between the first and second ones of the positioning references. This gives the print module a three point support that is optimally distributed over the module.

An adjustment mechanism can be provided for adjusting a position of the third one of the positioning references in the first direction. Thus the print modules can be displaced in the first direction which makes a fine-tuning possible in that direction. In the case of for example a plurality of different colour print modules being positioned next to each other in the second direction, the adjustment mechanism makes a fine-tuning possible of the one or more print heads of a specific colour relative to the other ones in the first direction.

The third one of the positioning references can be mounted by means of a connection organ to the base plate, which connection organ is designed to be elastically deformable in the first direction and rigid both in the displacement and second direction.

The positioning references or the positioning units preferably can be formed by balls. The balls are able to form well defined accurate alignment positions and help to smoothly guide the print module such that it can easily find its way to its accurately aligned print position.

The other ones of the positioning references and parts then for example can be formed by V-shaped grooves, of which a first and second one may extend in a same direction, in particular the first direction, and of which a third one may extend in a direction perpendicular thereto, in particular the displacement direction. In the alternative the other ones of the positioning references and parts can also be formed by a V-shaped groove, a cup shaped recess and a flat surface part. Thus for both examples, in the print position, the engagement between the print module and the sub-frame can be one of zero free play by having six degrees of freedom constrained: a position and a rotation angle on each (x, y, or z) axis.

The sub-frame can form part of or be rigidly connected to a main frame of the printing system. Preferably however the sub-frame can be a carriage that is movable in the second direction relative to the substrate holder back and forth during printing of a substrate. Electronics, ink tank, and the like for controlling and feeding the print heads then may be provided outside the carriage and for example mounted to the main frame while being connected by means of flexible cables and ducts to the print heads of the print module. This splitting of components makes it easier to quickly and accurately align the print module and keep them aligned during high acceleration and deceleration forces caused by back and forth scanning movements of the carriage over the substrate during printing.

The carriage preferably comprises a plurality of print modules next to each other in the second direction, in particular each destined for printing a different colour, wherein for each print module an individually operable set of four-bar link mechanisms is provided. This makes it lighter to quickly and accurately align the individual respective print modules.

Further preferred embodiments are stated in the subclaims.

The invention will now be described in further detail below in a non-limiting way by reference to the accompanying drawing in which:

FIG. 1 shows a schematic perspective view of a scanning type printing system;

FIG. 1*a* shows an enlarged partial view of FIG. 1;

Figure 3:
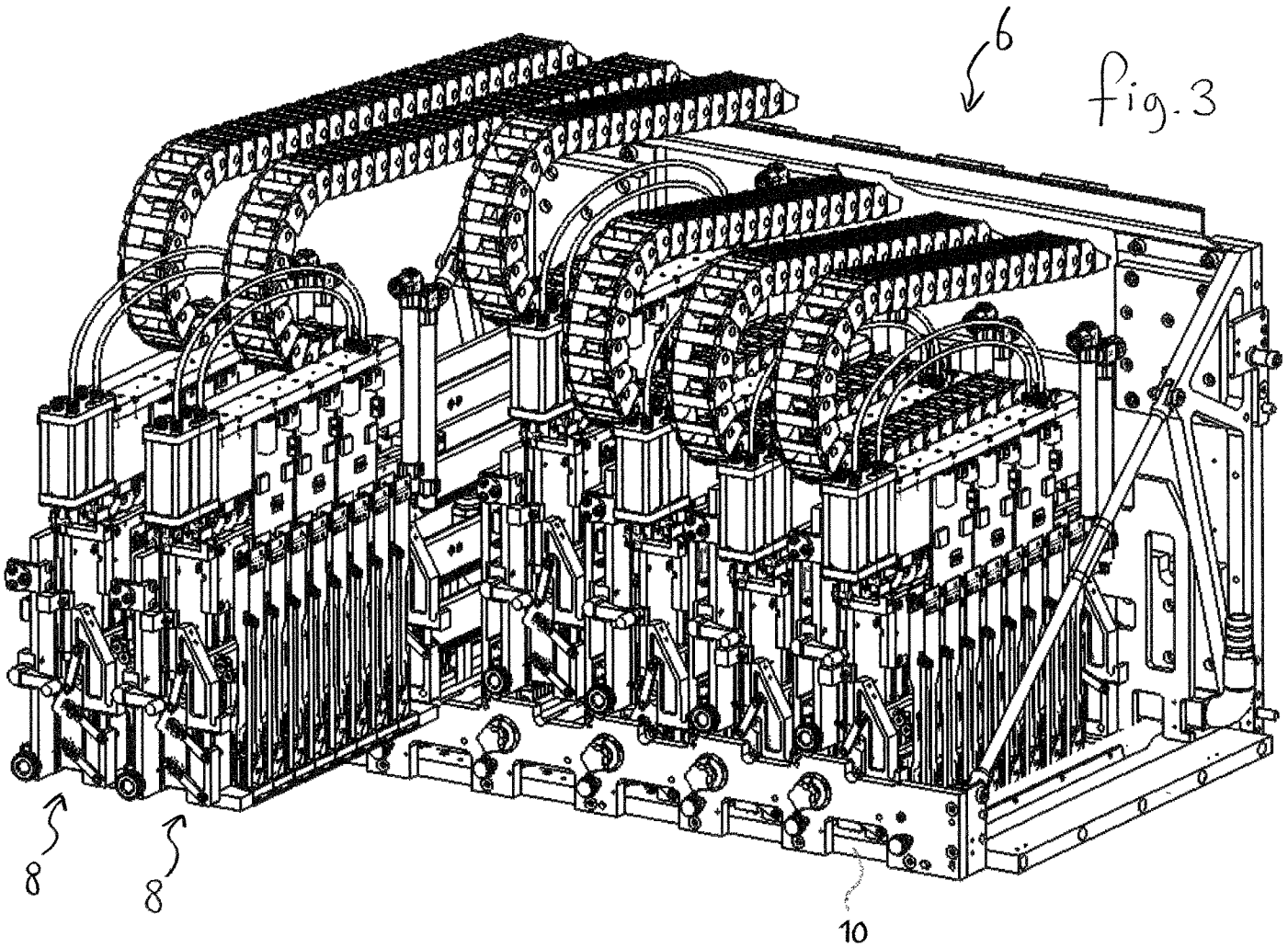
FIG. 3 shows a cut-away view of the carriage of FIG. 1 with print modules in various stages of movement between maintenance and print positions.
Figure 4:
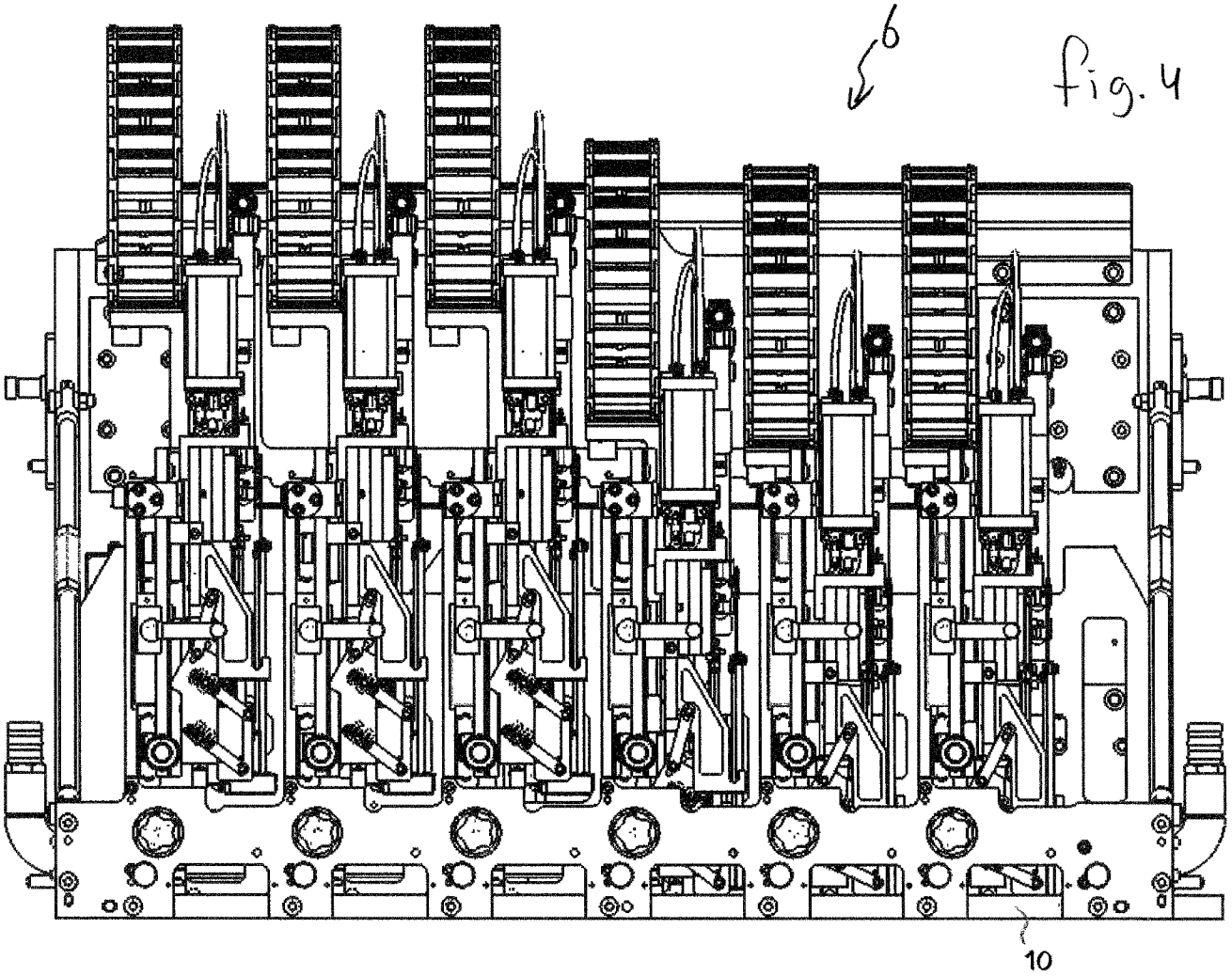
FIG. 4 shows an enlarged partial side view of FIG. 3.
Figure 4A:
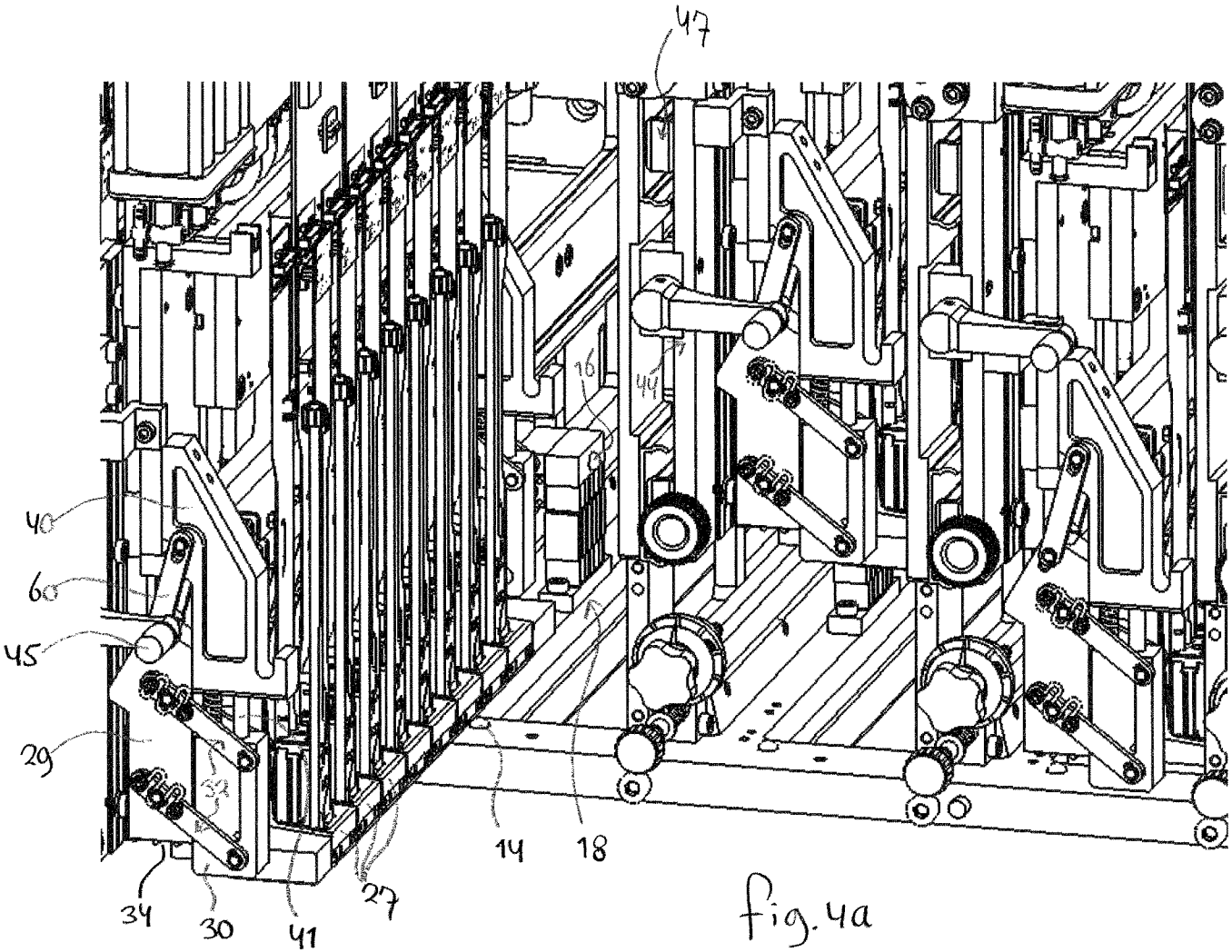
Figure 5A:
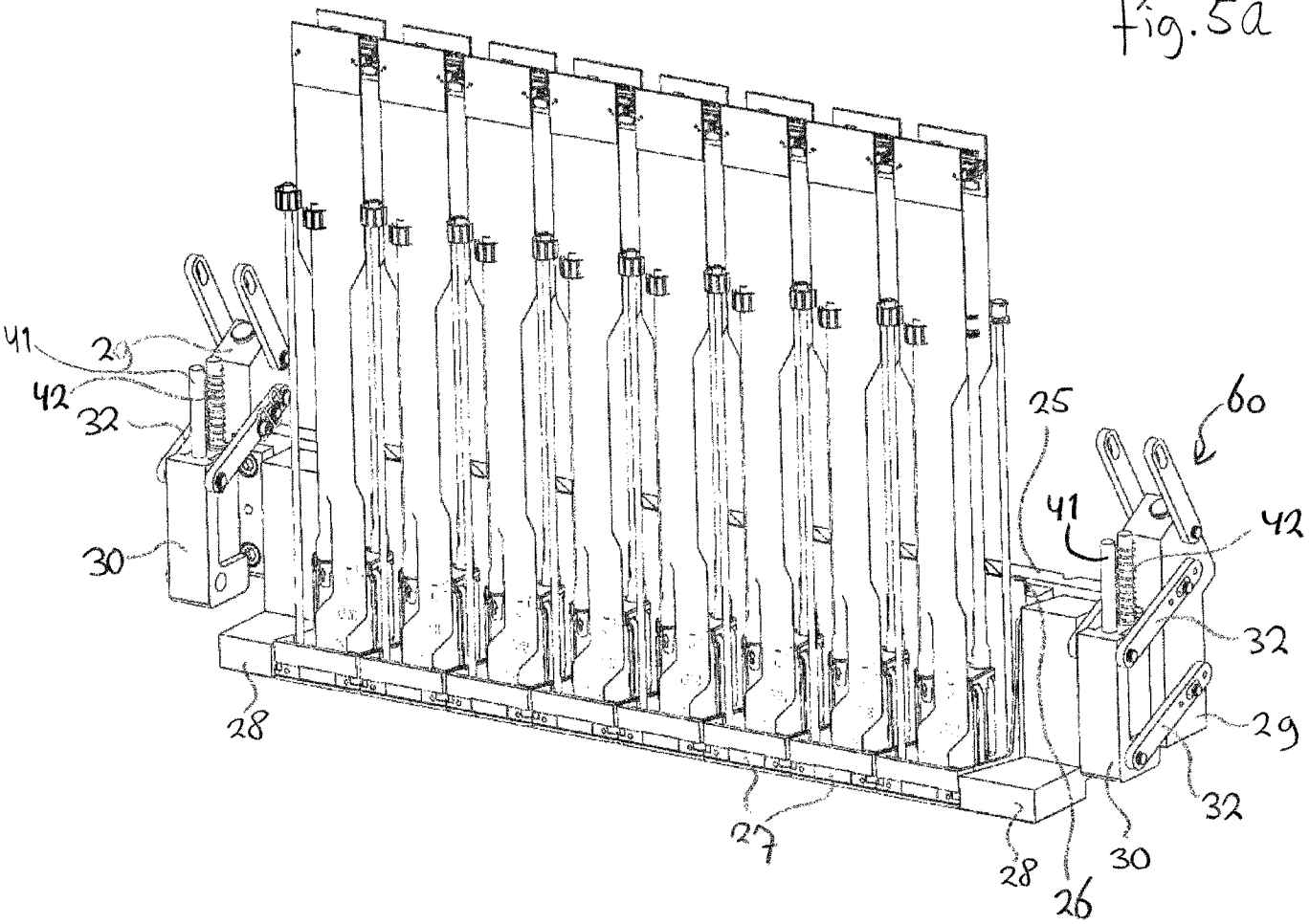
Figure 5A:
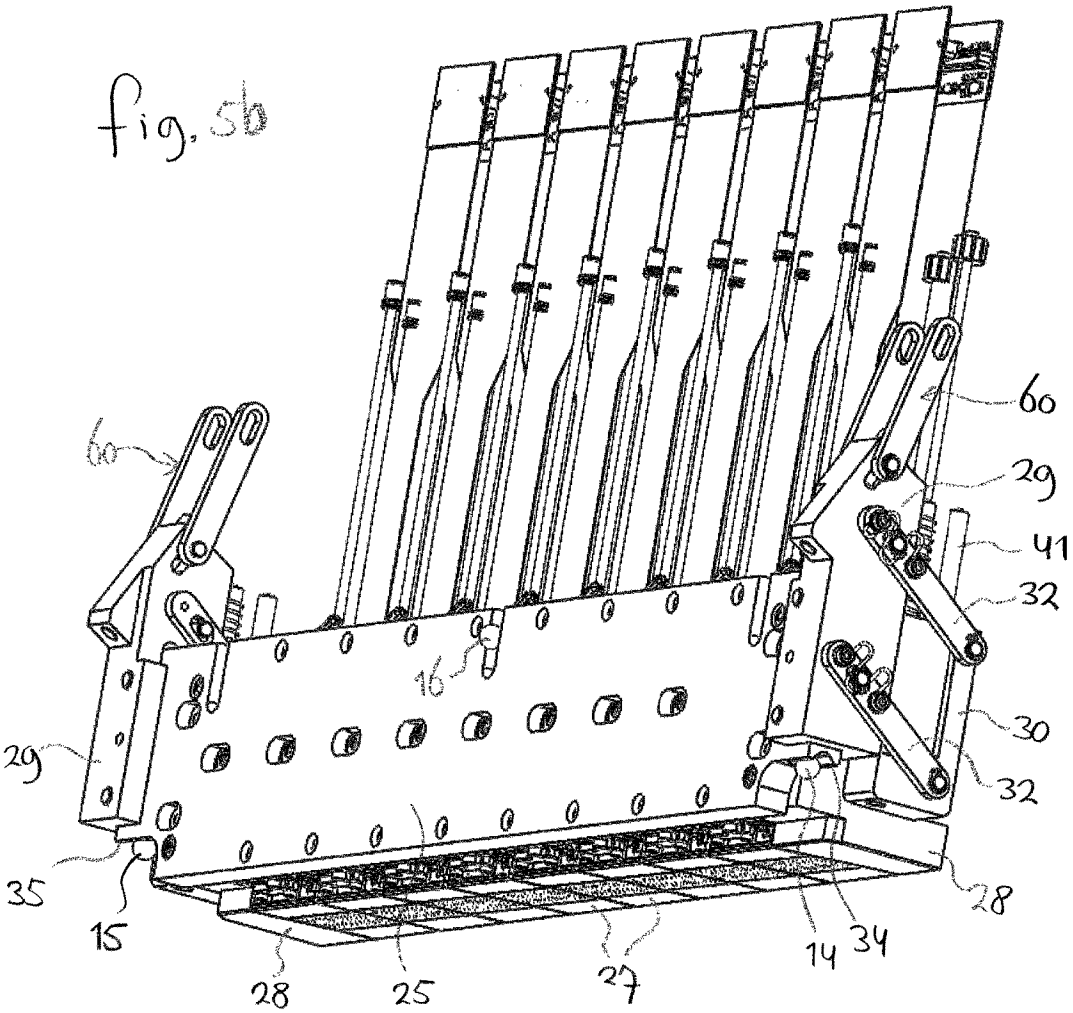
Figure 6A:
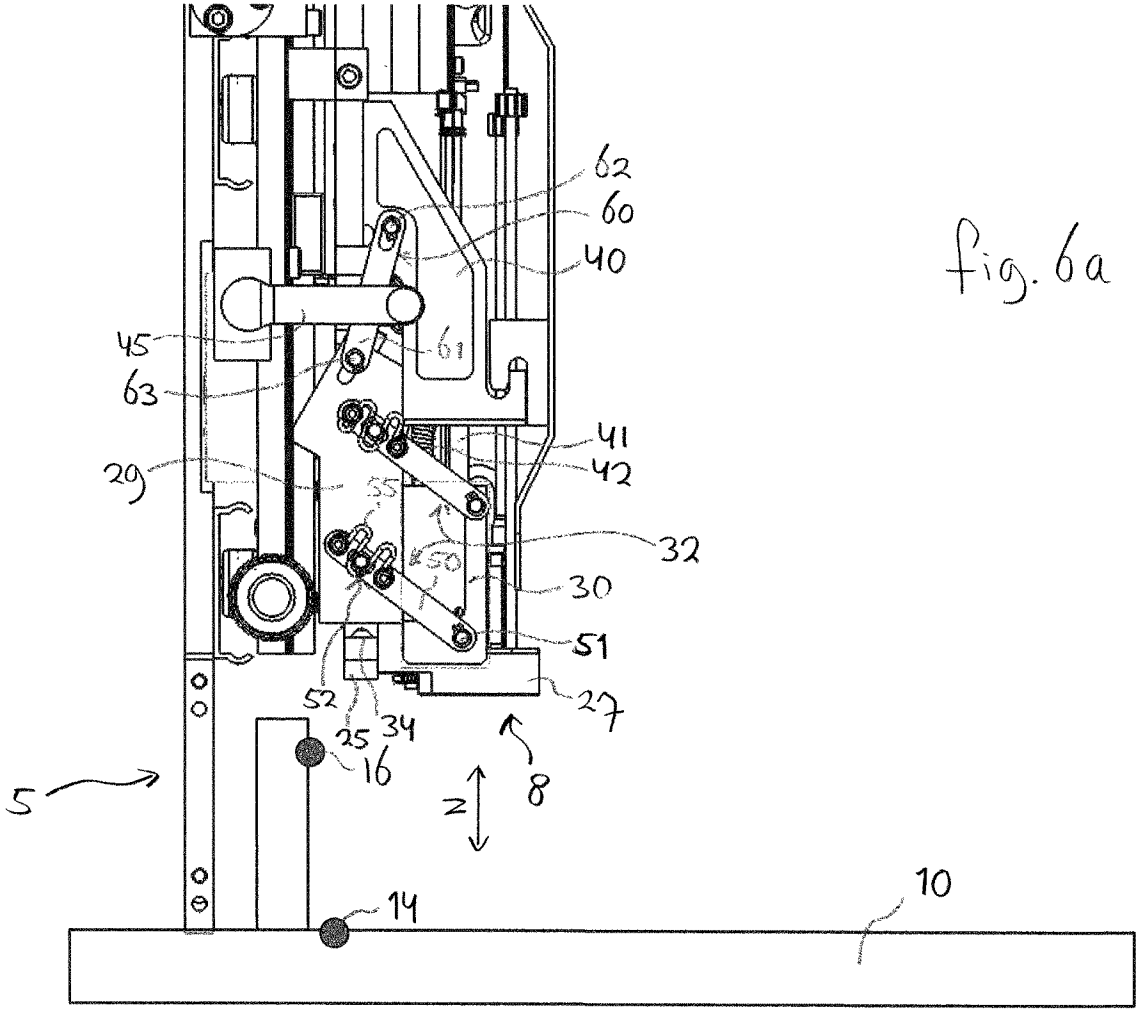
Figures 6B, 6C:
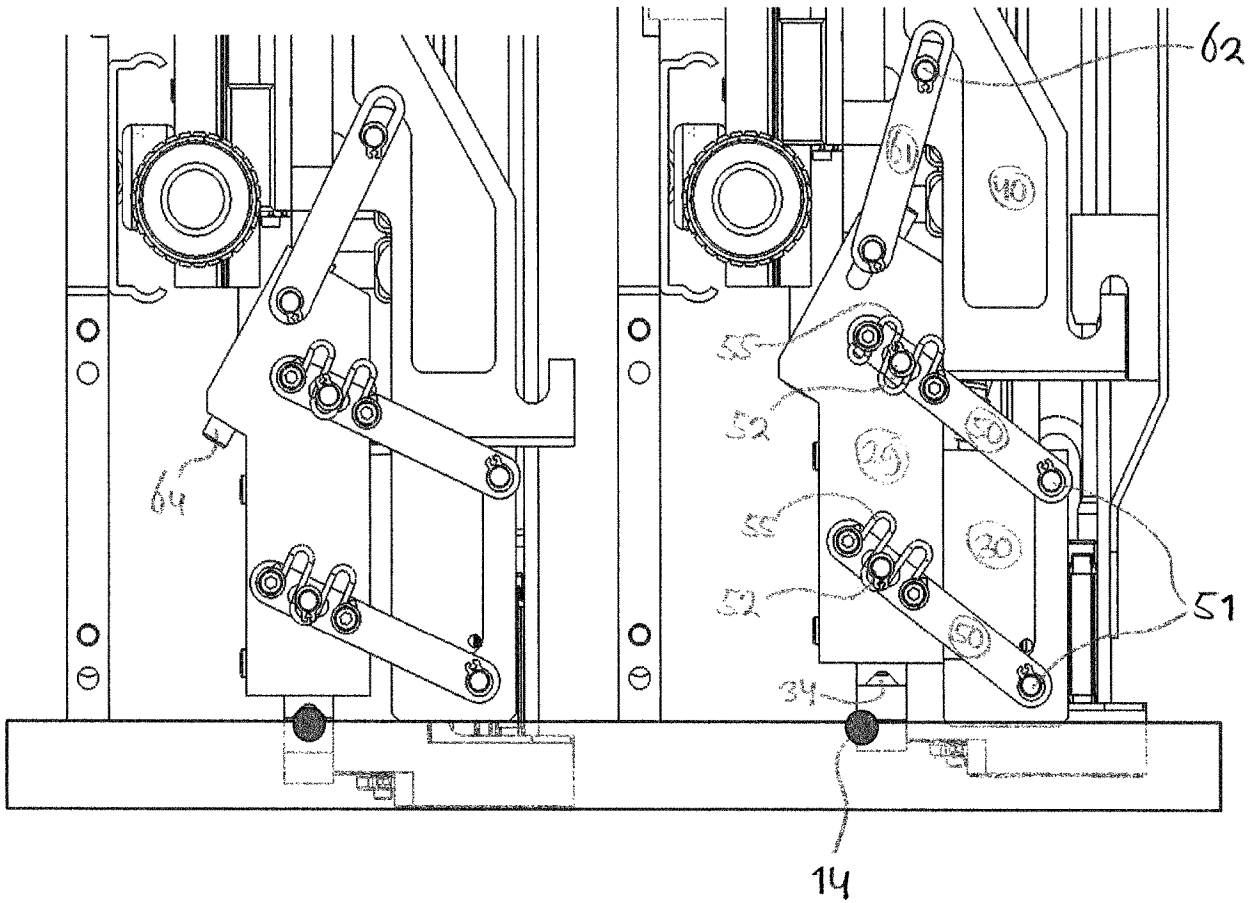
Figure 7A:
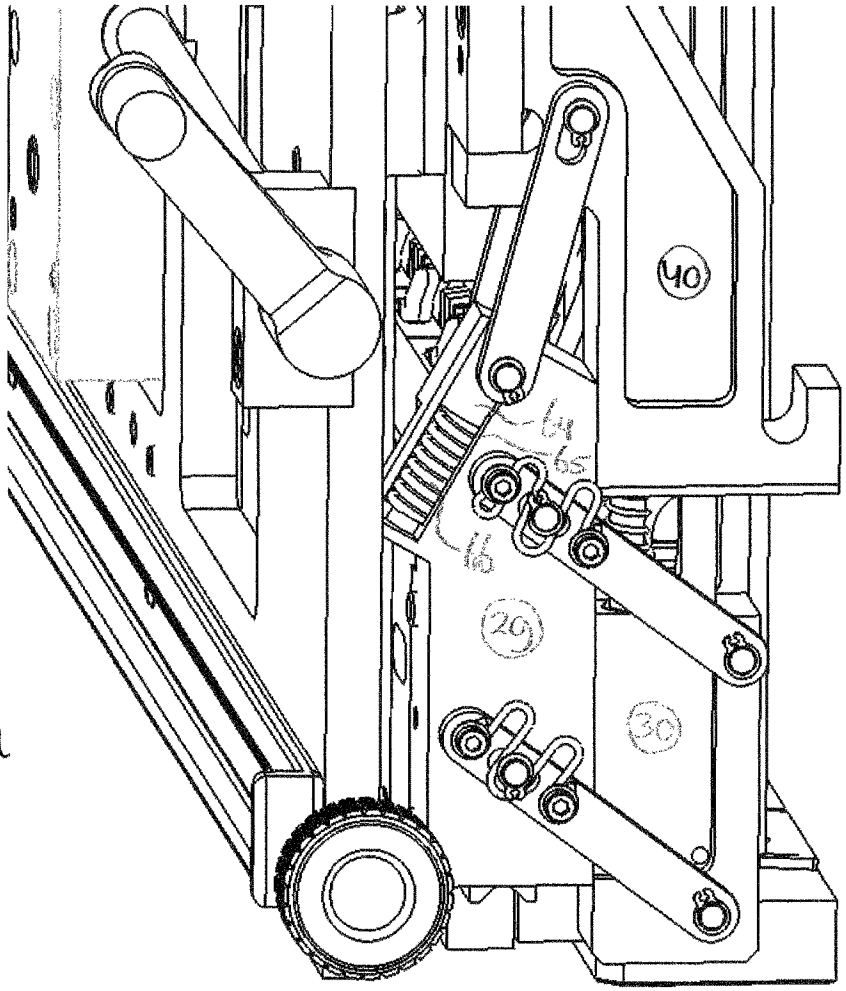
Figures 7B, 7C:
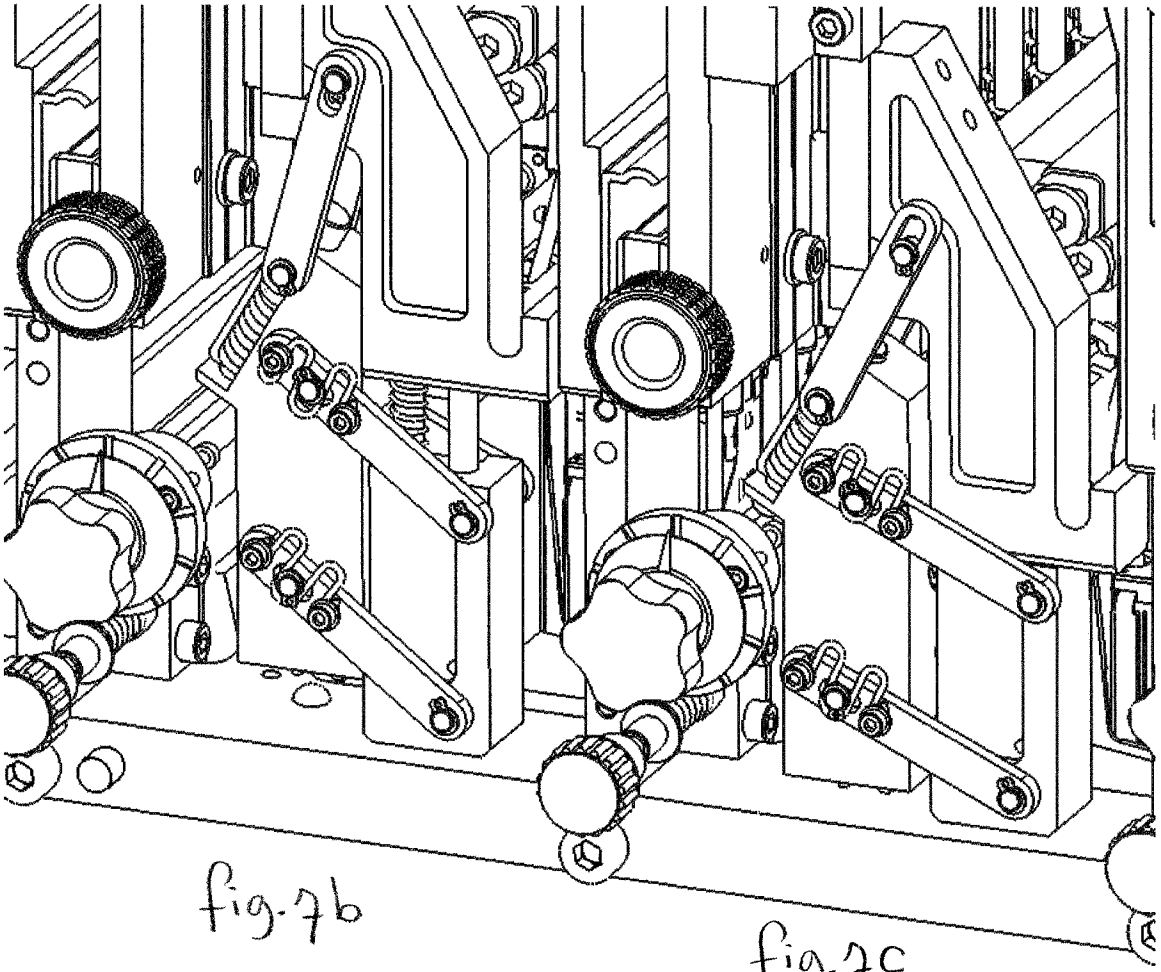

FIG. 4*a* shows a further enlarged partial view of FIG. 4;

FIG. 5*a, b* show top and bottom perspective views of an assembly of one of the print modules connected to a set of first support units via a set of four-bar linkage mechanisms;

FIG. 6*a, b, c* show partial side views of the various stages of movement between the maintenance and print positions of FIG. 3; and FIG. 7*a, b, c* show partially cut-away perspective views of FIG. 6*a, b* and *c*.

Figure 1:
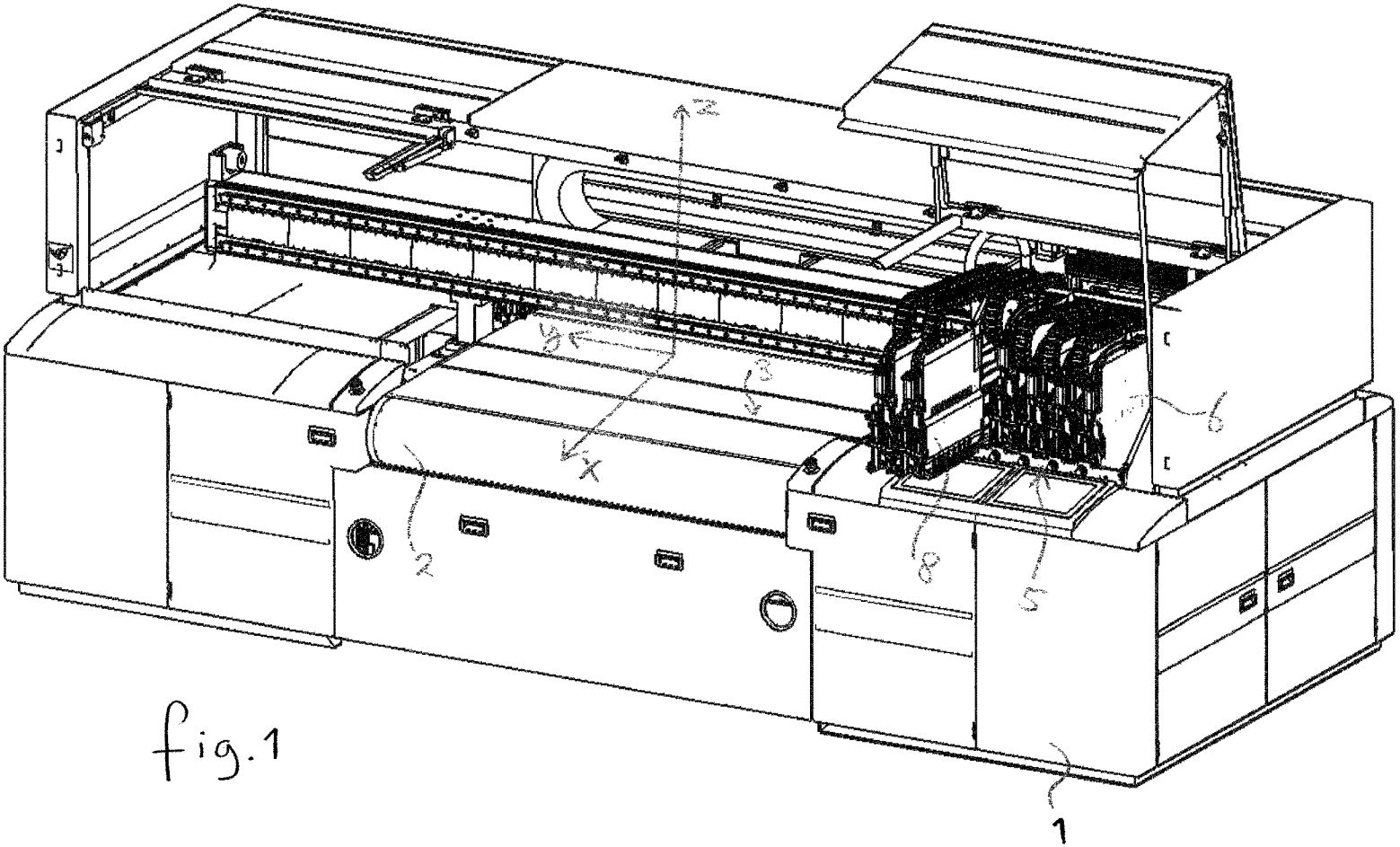
Figure 1A:
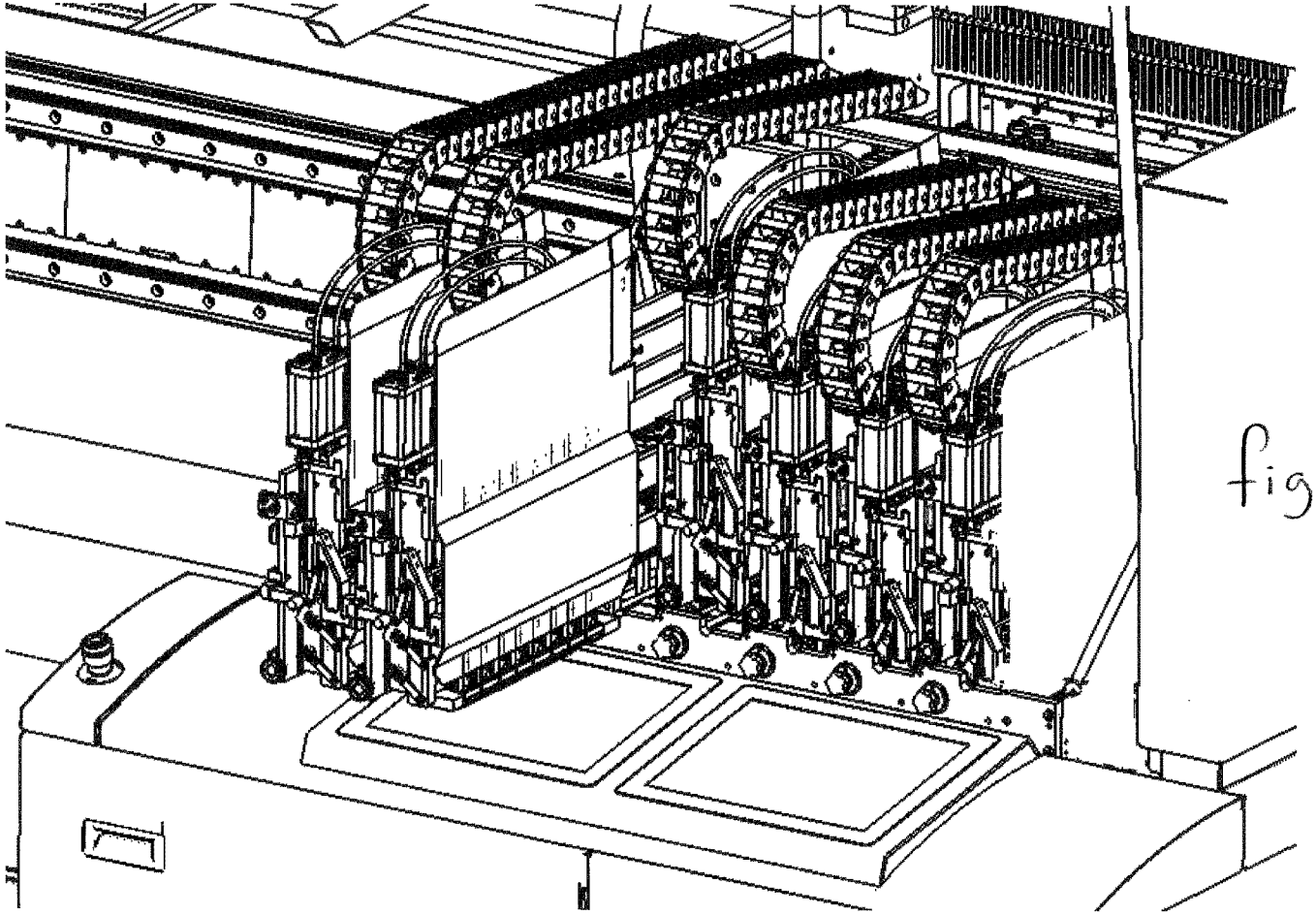

In FIG. 1 a scanning printing system is shown which has a main frame 1 that can be placed on the ground. The system comprises an operable conveyor belt as substrate holder 2 that is designed for supporting, holding and transporting a substrate 3 to be printed on. The substrate 3 is supported in a horizontal plane by the substrate holder 2 and can be moved by it in a transportation direction x (first direction). A sub-frame 5 forms a carriage 6 that is reciprocatingly movable in a scanning direction y (second direction) relative to the main frame 1 and the substrate 3. The x- and y-directions are perpendicular to each other. The carriage 6 holds six print modules 8 that are positioned adjacent each other in the y-direction. Each print module 8 is connected via a flexible duct to its own ink reservoir that is filled with its own distinctive colour and that is provided on the main frame 1. The print modules 8 are individually movable up and down in a vertical displacement direction z that is perpendicular to the x- and y-directions. Thus the print modules 8 can be moved towards and away accurately aligned print positions and maintenance positions where they are easily accessible for having maintenance performed thereto.

Figure 2:
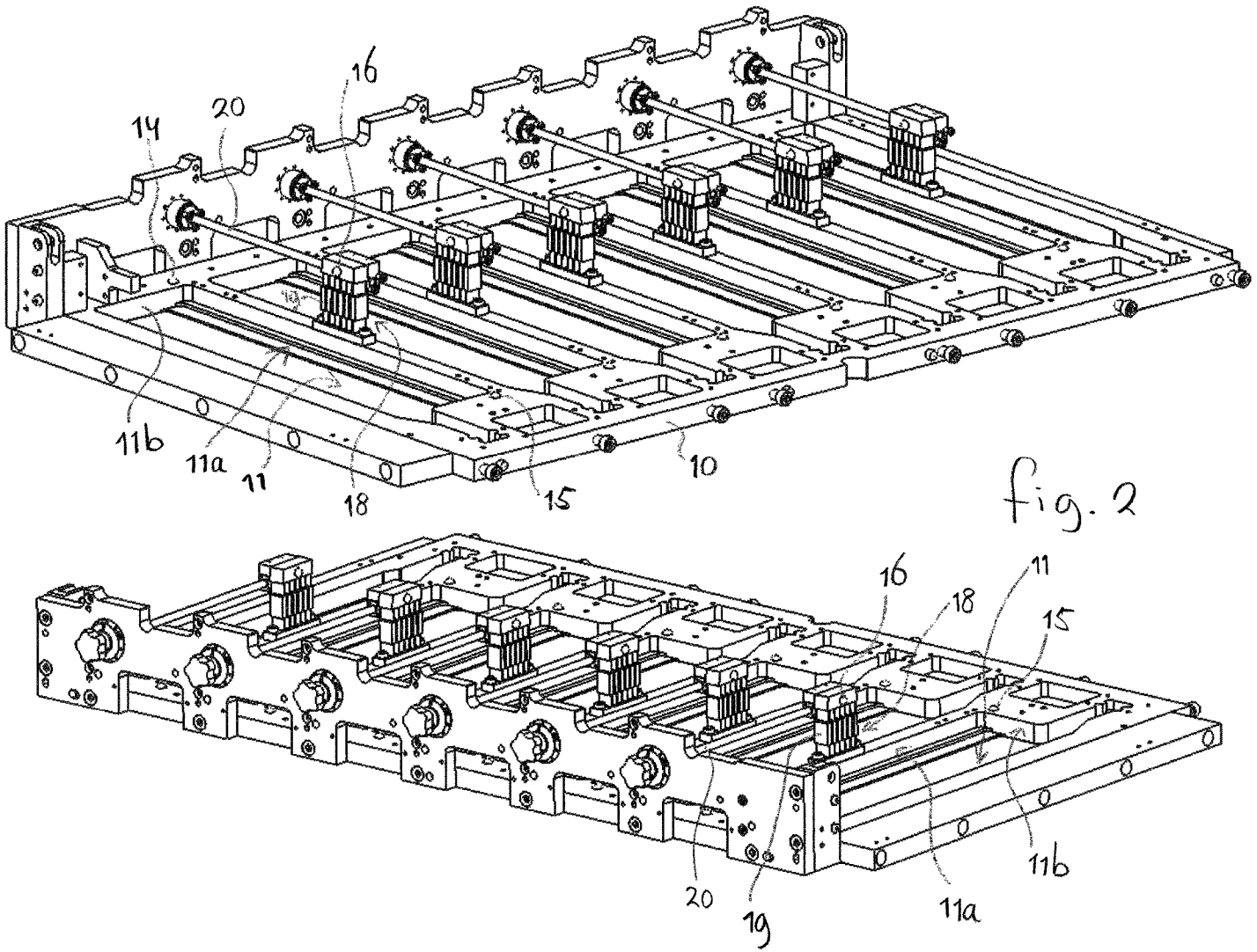
FIG. 2 shows a bottom part of the carriage of FIG. 1 seen from a back and front side and including a base plate with positioning references.

In FIG. 2 a bottom part of the carriage 6 is shown seen from a back side compared to FIG. 1. It comprises a base plate 10 with substantially rectangular openings 11, one for each print module 8. Long sides 11*a* of the openings 11 extend in the x-direction, short sides 11*b* extend in the y-direction. A first and second positioning ball 14, 15 are provided each along an opposing one of the short sides 11*b*. A third positioning ball 16 is provided at a center position along one of the long sides 11*a*. Thus the third positioning ball 16 lies spaced in both the x- and y-direction from the first and second positioning balls 14, 15. The first and second balls 14, 15 lie substantially in the plane of the base plate 10. The third ball 16 is provided on an upper part of a connection organ 18 that is mounted to the base plate 10, and lies at a higher level in the z-direction relative to the first and second balls 14, 15. The connection organ 18 comprises a number of elastic elements 19, for example leaf springs, which give flexibility in the x-direction, and rigidity in the y- and z-directions. The connection organ 18 is connected to an adjustment mechanism 20, here formed by a rod of which the x-position can be manually adjusted by means of a knob, via which the position of the third ball 16 can be adjusted in the x-direction.

In FIGS. 3 and 4 the base plate 10 with its six sets of positioning balls 14-16, one set for each opening 11, is shown together with the six print modules 8 in various stages of movement. Shown are a forwardly drawn maintenance position for the first and second print modules, a lifted position for the third print module, a coarsely lowered position for the fourth print module and an accurately aligned print position for the fifth and sixth print modules.

As can best be seen in FIG. 5*a*, each print module 8 comprises a plate-shaped carrier 25 that is provided with a number of holders 26 to which print heads 27 are mounted next to each other. At their outer ends the print heads 27 are bound by dummies or delimiters 28. Head ends of the carrier 25 are fixedly mounted to blocks 29. Each block 29 is connected to a first support unit 30 via a four-bar linkage mechanism 32.

The carrier 25 can best be seen in FIG. 5*b*. It comprises a first and second V-shaped groove 34, 35 that extend in the x-direction along opposing lower edge side parts of the carrier 25. A third V-shaped groove 36 that extends in the z-direction is provided at a center position at an upper part of a side surface of the carrier 25. The balls 14-16 that are actually connected to the base plate 10 of the carriage 6 are also schematically shown in FIG. 5*b* while lying in the grooves 34-36. This shows the form fit between the balls and the grooves as well as the ability of the balls to slide through their corresponding grooves towards their accurately aligned print position.

As can be seen in FIG. 3-7, each first position unit 30 is slideably connected to a second support unit 40 via a first guiding mechanism 41 that here is formed by two rods that extend in the z-direction. A spring 42 is provided over one the rods (see FIG. 5) which biases the first and second support units 30, 40 away from each other in the z-direction.

The second support unit 40 can be displaced up and down in the z-direction with a rack or spindle 44 that extends in the z-direction along one or more pinion or gear wheels. This displacement for example can be initiated by a manual operation of a crank handle 45 that rotates one of the pinion or gear wheels.

The pinion or gear wheels are mounted to a second guiding mechanism 47 that in turn is mounted to the carriage 6. The second guiding mechanism 47 here is formed by a rail that is telescopically extendable in the x-direction. The second support unit 40 can thus for example be manually pulled forward in the x-direction into its maintenance position.

Each four-bar linkage mechanism 32 comprises two rigid parallel guiding arms 50 that extend slanting upwards in the y-z plane between the block 29 of the print module 8 and the first support unit 30. Each arm 50 is connected to the first support unit 30 via a hinge joint 51 that comprises a substantially play-free pen-hole connection. Furthermore each arm 50 is connected to the block 29 via a hinge joint 52 that comprises a slidable pen-slit connection. The slidable pen-slit connection has a slit that extends in a longitudinal direction of the arm 50, and has a pen that is connected to the block 29 of the print module 8. The pen is able to rotate inside the slit as well as to slide through the slit in the longitudinal direction against a biasing force of a spring 55. The spring 55 is provided to bias the pen towards an intermediate position inside the slit.

A force actuator 60 that comprises a rigid operating arm 61 is active between the second support unit 40 and the block 29 of the print module 8. The arm 61 extends slanting downwards in the y-z plane between the second support unit 40 and the block 29 of the print module 8. With this the operating arm 61 extends substantially perpendicular to the guiding arms 50. The arm 61 is connected to the second support unit 40 via a hinge joint 62 that comprises a slidable pen-slit connection having a slit that extends in a longitudinal direction of the arm 61 and having a pen that is connected to the second support unit 40. The pen is able to slide through the slit in its longitudinal direction.

Furthermore the arm 61 is connected via a hinge joint 63 to a piston 64 that is slidable in a cylinder opening 65 that is provided in the block 29. See FIG. 7 where the block 29 is partially cut-away for giving a good view on this biased piston-cylinder mechanism of the force actuator 60. The cylinder opening 65 here extends in a direction that is substantially perpendicular to the longitudinal direction of the arms 50 of the four-bar linkage mechanism 32. A spring 66 is provided between the piston 64 and the cylinder opening 65 for biasing the block 28 in a slanting downwards direction away from the second support unit 40 and thus force the carrier 25 downwards with its V-shaped grooves 34, 35 towards the first and second positioning balls 14, 15 as well as sideways with its V-shaped groove 36 towards the third positioning ball 16.

The positioning mechanism now can be operated as follows:

Starting from the maintenance position as shown for the first and second print modules in FIG. 3, the print module 8 can be pushed inwards along the second guiding mechanism 47. Thus the situation as shown for the third print module in FIG. 3 is obtained. Subsequently the second support units 40 can be lowered by means of operation of the crank handle 45 in the z-direction while taking the first support units 30, the four-bar linkage mechanisms 32 and the print module 8 held between them, along with it. This lowering can be continued until the first support unit 30 runs against the bottom plate 10. Thus the situation as shown for the fourth print module in FIG. 3 is obtained. A continuation of the operation of the crank handle 45 for moving the second support unit 40 further downwards then shall automatically cause the operating arm 61 of the force actuator 60 to start exerting a slanting downwardly directed pushing force onto the blocks 29 of the print module 8. The print module 8 then shall start to simultaneously translate and rotate downwards and sideways in such a way that substantially at a same time each of the V-shaped grooves 34-36 gets placed over and against its corresponding ball 14-16. With this the springs 55 of the four-bar linkage mechanism and the spring 66 of the force actuator 60 give the print module 8 compliance to freely find its accurately aligned print position and then be kept biased into that print position. Thus the situation as shown for the fifth and sixth print module in FIG. 3 is obtained.

For moving the print module 8 from its print position towards its maintenance position the above operation can be performed the other way around.

Besides the shown embodiment all kinds of variants are possible. For example the number and types of print heads can be varied. It is also possible to use the four-bar linkage mechanism as positioning mechanism in other types of printing systems, like in a single pass system. Instead of the parallelogram construction, the four-bar linkage mechanism can also be constructed with differently dimensioned, shaped or orientated arms in order to obtain another imaginary path along which the four-bar linkage mechanism then is able to guide the print module towards and away from its print position. Instead of having the displacement direction extending in the vertical direction, it is also possible to use the invention for displacements in other directions, like for example slanted ones along a curved path of a substrate to be printed, or even upside down when that is desired.

Instead of the four-bar linkage mechanism being connected to the first and second support unit that are movable relative to the sub-frame in the z-direction, it is noted that the four-bar linkage mechanism can also advantageously be used when the first and/or second positioning unit are fixedly connected to the sub-frame. The print module then gets solely moved relative to the sub-frame by means of the four-bar linkage mechanism. Furthermore it is noted that instead of using the force actuator between the second support unit and the print module for having the print module perform its alignment movements, it is also possible to have the print module forced to move in other ways. For example the force actuator can be provided between the sub-frame and the print module or between the sub-frame and the four-bar linkage mechanism and then be operated, for example electrically, pneumatically or hydraulically, to exert pulling or pushing forces onto the print module or onto the four-bar linkage mechanism. It is also possible to actuate the four-bar linkage mechanism to rotate clockwise or anti-clockwise by means of a controllable drive unit, like an electrically, pneumatically or hydraulically operable motor, that acts directly onto the four-bar linkage mechanism, and thus also have the print module forced to perform its alignment movements.

Thus according to the invention a printing system is provided with an optimized combination of a compliant and biased translational and rotational movement of print modules towards accurate aligned print positions while not having to make use of gravity forces and while at a same time preventing wear or damaging of the cooperating positioning references and positioning units that are critical to the accurate alignments of the print modules.

The invention claimed is:

1. A printing system comprising:

a sub-frame;

a print module having a carrier with one or more printheads connected thereto;

a first support unit that is connected to the sub-frame;

a substrate holder for supporting a substrate to be printed on by the print module; and a positioning mechanism for moving the print module relative to the first support unit to and from a print position;

wherein a set of positioning parts is provided that form part of or are connected to the print module, wherein a set of positioning references is provided that form part of or are connected to the sub-frame, wherein the positioning parts are engageable with corresponding ones of the positioning references for aligning the print module relative to the sub-frame when moved into its print position, wherein the positioning mechanism comprises one or more four-bar linkage mechanisms acting between the print module and the first support unit, and wherein the four-bar linkage mechanism is designed to move the print module to and from the positioning references while allowing the print module to move relative to the first support unit in six degrees of freedom when the positioning parts of the print module start engaging with the positioning references.

2. The printing system according to claim 1, wherein each four-bar linkage mechanism comprises arms that extend between the print module and the first support unit, wherein the arms are connected to the print module and the first support unit by means of hinge joints, and wherein at least one of the hinge joints of each arm comprises a slidable pen-slit connection.

3. The printing system according to claim 2, wherein the pen of the pen-slit connection is biased towards an intermediate position inside the slit by means of one or more springs.

4. The printing system according to claim 1, wherein the four-bar linkage mechanism is a parallelogram four-bar linkage mechanism.

5. The printing system of claim 1, wherein the first support unit is movable in a displacement direction relative to the sub-frame.

6. A printing system comprising:

a sub-frame;

a print module having a carrier with one or more printheads connected thereto;

a first support unit that is connected to the sub-frame and movable in a displacement direction relative to the sub-frame;

a substrate holder for supporting a substrate to be printed on by the print module; and a positioning mechanism for moving the print module relative to the first support unit to and from a print position;

wherein a set of positioning parts is provided that form part of or are connected to the print module, wherein a set of positioning references is provided that form part of or are connected to the sub-frame, wherein the positioning parts are engageable with corresponding ones of the positioning references for aligning the print module relative to the sub-frame when moved into its print position, wherein the positioning mechanism comprises one or more four-bar linkage mechanisms acting between the print module and the first support unit, wherein a second support unit is provided that is movable in the displacement direction relative to the sub-frame, wherein the first support unit is mounted to the second support unit via a first guiding mechanism allowing the first support unit to be moved relative to the second support unit in the displacement direction, and wherein a force actuator is provided between the second support unit and the print module such that a moving of the first and second support units to and from each other in the displacement direction causes the four-bar linkage mechanism to be operated.

7. The printing system according to claim 6, wherein the force actuator comprises an arm that extends between the print module and the second support unit, wherein the arm is connected to the print module and the second support unit by means of hinge joints, and wherein one of the hinge joints comprises a slidable pen-slit connection.

8. The printing system according to claim 6, wherein the force actuator operates a spring that is placed between the force actuator and the print module.

9. The printing system according to claim 6, wherein the second support unit is mounted to the sub-frame via a second guiding mechanism allowing the second support unit to be moved in a direction other than the displacement direction towards a maintenance position.

10. A printing system comprising:

a sub-frame;

a print module having a carrier with one or more printheads connected thereto;

a first support unit that is connected to the sub-frame and movable in a displacement direction relative to the sub-frame;

a substrate holder for supporting a substrate to be printed on by the print module; and a positioning mechanism for moving the print module relative to the first support unit to and from a print position;

wherein a set of positioning parts is provided that form part of or are connected to the print module, wherein a set of positioning references is provided that form part of or are connected to the sub-frame, wherein the positioning parts are engageable with corresponding ones of the positioning references for aligning the print module relative to the sub-frame when moved into its print position, wherein the positioning mechanism comprises one or more four-bar linkage mechanisms acting between the print module and the first support unit, wherein the sub-frame comprises a base plate with one or more openings for giving the one or more print heads of the print module access to the substrate in the print position, which base plate extends in a first and second direction that are perpendicular to each other and to the displacement direction, and wherein the set of positioning references comprises three positioning references, a first and second one of which are provided spaced from each other in the first direction at a same position in the displacement direction, and a third one of which is provided at another position in the second direction than the first and second one at another position in the displacement direction than the first and second one.

11. The printing system according to claim 10, wherein the third one of the positioning references is provided at a center position in the first direction in between the first and second ones of the positioning references.

12. The printing system according to claim 10, wherein an adjustment mechanism is provided for adjusting a position of the third one of the positioning references in the first direction.

13. The printing system according to claim 12, wherein the third one of the positioning references is mounted with a connection organ to the base plate, which connection organ is elastically deformable in the first direction and rigid in the second direction and in the displacement direction.

14. A printing system comprising:

a sub-frame;

a print module having a carrier with one or more printheads connected thereto;

a first support unit that is connected to the sub-frame;

a substrate holder for supporting a substrate to be printed on by the print module; and a positioning mechanism for moving the print module relative to the first support unit to and from a print position;

wherein a set of positioning parts is provided that form part of or are connected to the print module, wherein a set of positioning references is provided that form part of or are connected to the sub-frame, wherein the positioning parts are engageable with corresponding ones of the positioning references for aligning the print module relative to the sub-frame when moved into its print position, wherein the positioning mechanism comprises one or more four-bar linkage mechanisms acting between the print module and the first support unit, and wherein the sub-frame is a carriage that is movable back and forth in a transverse direction along the substrate holder during printing of a substrate.

15. The printing system according to claim 14, wherein the carriage comprises a plurality of print modules next to each other in the transverse direction, wherein for each print module an individually operable set of four-bar link mechanisms is provided.

16. The printing system of claim 14, wherein the first support unit is movable in a displacement direction relative to the sub-frame.

* * * * *